United States Patent [19]

Petty

[11] Patent Number: 4,796,861

[45] Date of Patent: Jan. 10, 1989

[54] PORTABLE RAM, ENGINE STAND AND TRANSMISSION CRADLE

[75] Inventor: James W. Petty, Rolla, Mo.

[73] Assignee: Donald W. Petty, Rolla, Mo. ; a part interest

[21] Appl. No.: 101,823

[22] Filed: Sep. 28, 1987

[51] Int. Cl.[4] ..... B66F 5/02

[52] U.S. Cl. ..... 254/8 B; 254/124; 254/134; 254/DIG. 16

[58] Field of Search ..... 254/8 R, 8 B, 124, 133, 254/134, DIG. 16; 269/17, 16; 414/680; 100/103; 29/252, 251, 401.1

[56] References Cited

U.S. PATENT DOCUMENTS

| | | | |
|---|---|---|---|
| 2,814,394 | 11/1957 | Witcher . | |
| 2,851,247 | 9/1958 | Hilding . | |
| 3,059,785 | 10/1962 | Buckeye . | |
| 3,667,632 | 6/1972 | Tidswell . | |
| 4,118,010 | 10/1978 | Hanscom | 254/134 |
| 4,190,233 | 2/1980 | Godfrey | 254/8 B |
| 4,479,632 | 10/1984 | Colvette . | |
| 4,523,888 | 6/1985 | Pezzner et al. . | |
| 4,669,703 | 6/1987 | Hawkins et al. | 254/8 B |

*Primary Examiner*—Robert C. Watson

*Attorney, Agent, or Firm*—Glenn K. Robbins

[57] ABSTRACT

A portable lifting jack with ram, engine stand and transmission cradle. The jack is comprised of a boom for hoisting objects, an engine stand, transmission cradle, and a hydraulic ram and press assembly. The ram press is incorporated into the front vertical base of jack and provides a counter weight and also allows the press, engine stand and transmission cradle to be used simultaneously. The jack is equipped with caster wheels and the legs and boom are extendable to enable the jack to be placed in any necessary position.

10 Claims, 2 Drawing Sheets

PORTABLE RAM, ENGINE STAND AND TRANSMISSION CRADLE

BACKGROUND OF THE INVENTION

Figure 1:
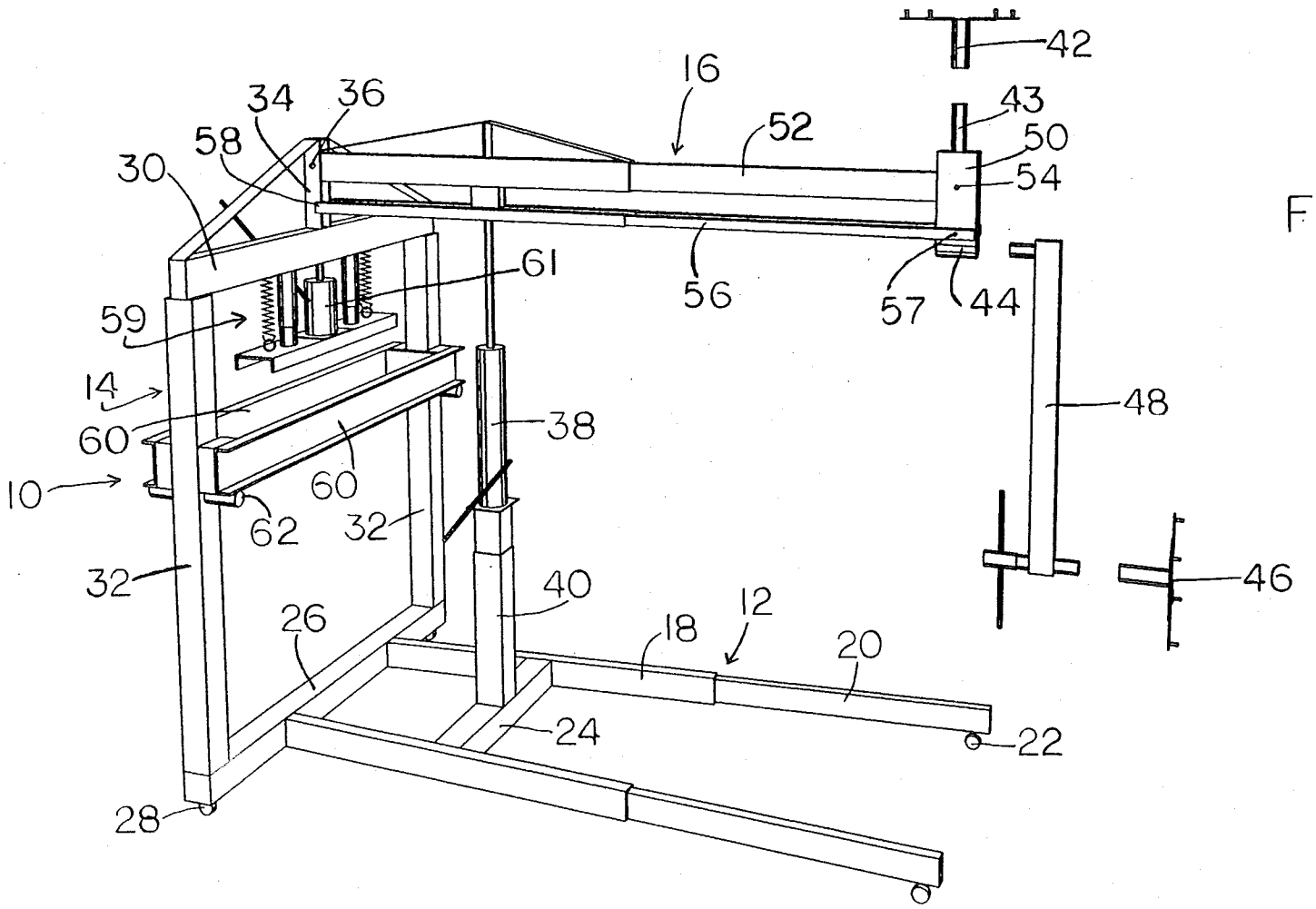

This invention relates to portable lifting jacks which may be used in automotive and machine shops. It involves a combined unit of an engine stand, transmission cradle and ram press.

The concept of portable floor jacks is conventional as are the separate aspects of the engine stand, transmission cradle and ram press. Other inventions incorporate multiple features but their simultaneous functionality is limited.

There is a need for a portable lifting jack that can simultaneously employ the features of the lifting crane, engine stand, transmission cradle and ram press. It is desirable to use the ram press while the engine and transmission are suspended on the jack. Therefore, it is necessary that the press be completely and separately functionable. In the prior art, press and boom capabilities did not exist simultaneously. The apparatus would operate exclusively either in the boom mode or the press mode, not both.

SUMMARY OF THE INVENTION

By means of the instant invention there has been provided a portable lifting jack which will allow the simultaneous functions of suspending an engine and transmission while also enabling the operation of a ram press.

The lifting jack is comprises of heavy construction square metal tubing, such as steel or the like, to meet the demands of rigorous use. The jack is equipped with two extendable base legs which are splayed out toward its front end to provide stability. Caster wheels are employed for easy mobility.

The rear of the jack is comprised of vertical support legs connected and braced together by horizontal cross beams. The legs and cross beams provide a frame supporting both the ram press and the boom. The frame extends at right angles to the boom and provides additional stability and counter weight.

The top cross beam supports two vertically rising metal straps which house the anchoring and pivot points for the boom.

The boom is comprised of heavy construction square tubing to resist twisting. It attaches to the vertical support in a hinging pivot relationship. The boom extends telescopically to enable it to be adjusted to varying lengths. Two supporting rods which are also telescopically extendable extend parallel underneath the boom. They are also hinged in a pivot arrangement on the vertical support.

Raising and lowering the boom is effected by the employment of a hydraulic jack or the like. The jack base rests on an extendable vertical support. The vertical jack support is braced against a cross beam connecting the two base legs. The jack head butts up against the boom arm whereby raising and lowering is effected.

The end of the boom arm is adapted to simultaneously or alternately accept a transmission cradle and act as an engine stand. An adapter arm is also provided to supplement the engine stand feature.

The parallel supporting rods are independently adjustable with respect to the telescoping boom and serve to prevent skew and to rotate the suspended engine and/or transmission along the vertical plane. They extend telescopically independent of the boom arm and are also independently pivotally connected to the engine and transmission adapter.

It is an object of this invention to provide the characteristics of a portable lifting jack combined integrally with a ram press. The press operates between the two cross braces of the vertical support at the rear of the unit.

It is further object of this invention to provide a lifting jack whereby the functions of suspending an engine or a transmission and operation of a ram press may be performed simultaneously.

It is still further an object of this invention to enable the suspended engine and transmission to be rotated along the vertical plane in order to gain better access to all surfaces.

The above features are object of this invention. Further objects will appear in the detailed description which follows and will be further apparent to those skilled in the art.

For the purpose of illustration of this invention, a preferred embodiment thereof is shown in the accompanying drawing. It is to be understood that the drawing is for purpose of description only and that the invention is not limited thereto.

IN THE DRAWING

Figure 2:
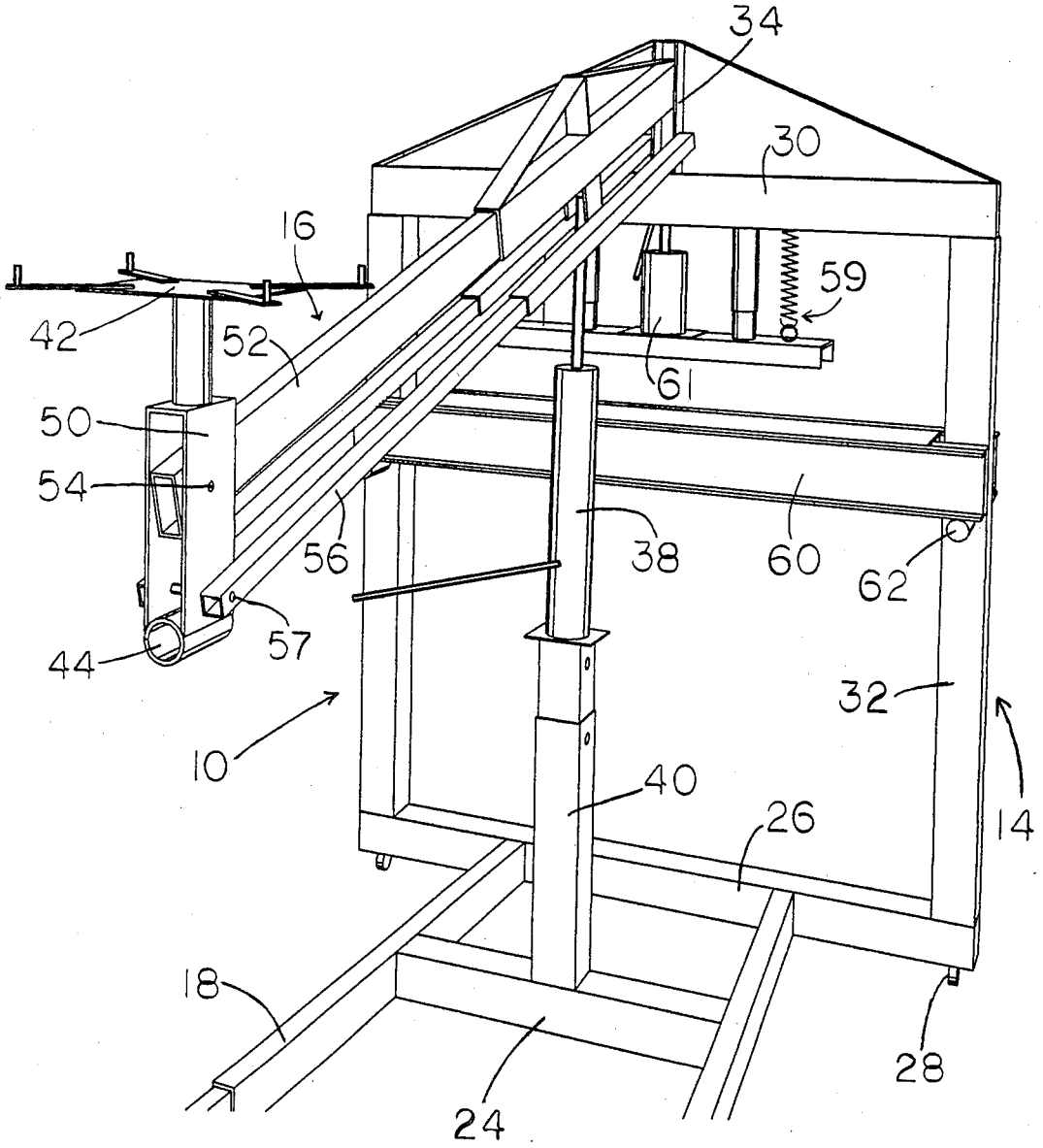

FIG. 1 is a pictorial view of the front and right side of the jack showing the ram press lifting jack along with the accessories and the engine stand adapter arm; and FIG. 2 is a pictorial fragmentary view from the right side of FIG. 1 showing the ram press and the lifting jack slightly lowered.

DESCRIPTION OF THE INVENTION

The portable lifting jack of this invention is generally indicated by the reference numeral 10 in FIGS. 1 and 2. It is generally comprised of a base support 12, vertical support frame 14, and boom arm 16.

The lifting jack unit is constructed of heavy-duty metal tubing of steel or the like. The tubing is preferably square to minimize twist or skew of the various supports. The base support 12 is comprised of splayed or divergent telescopically extendable legs 18 and 20 to provide greater reach of the lifting jack and also to increase the counter-balancing effect of the base support. Caster wheels 22 are attached to the bottom of the ends of legs 20 to provide easy movement along a floor for the lifting jack unit. Base legs 18 are connected to each other by cross-brace 24 for further stability.

Base legs 18 are connected at their rearward end, by welding or other means, to cross-brace 26 of the vertical support frame 14. Cross-brace 26 is also provided with caster wheels 28 at both ends on the underneath side.

The vertical support frame 14 is comprised of a rectangular-shaped framework consisting of cross-braces 26 and 30 and vertical legs 32. Two metal straps 34 are welded perpendicularly on to cross-brace 30. The gap between the straps serves to house the hinge and pivot 36 for the boom 16.

The boom 16 extends out telescopically in order to attain the desired length of the boom arm. The raising and lowering of the boom 16 is effected by the use of a hydraulic jack or the like 38, the base of which rests on an adjustable vertical support 40 and is retained by a vertical pin (not shown).

The end of the boom 16 is adapted to accept a transmission cradle 42 by a vertical socket 43 and horizontal sleeve 44 accepts an engine stand plate 46. An engine stand adapter arm 48 is provided as an extension in suspending the engine. The aforesaid socket and sleeve adaptations for suspending transmissions and engines are incorporated into a bifurcated bracket or yoke 50.

Arm 52 of boom 16 is pivotally attached to bracket 50 at 54. The boom is equipped with two parallel supporting rods 56 which are pivotally attached by pin 57 to the bracket 50 independently of boom arm 52. These supporting rods are also telescopically extendable and are pivotally attached at their rearward end by pin 58 to metal straps 34. The employment of the two parallel support rods and boom and construction of square or rectangular tubing minimizes any tendency to twist or skew under load.

Vertical support frame 14 also serves as the housing for ram press 59. The press is attached by its upper end to crossbrace 30.

Cross-I-beams 60 serve as the press bed against which a conventional hydraulic jack 61 can be moved to press any work piece positioned therebetween. Vertical legs 32 are fitted with multiple holes to accomodate pegs 62 on which cross-beams 60 rest. The pegs may be adjusted to various heights on the vertical legs in order to increase the effective working area under the press.

USE

The portable lifting jack of this invention is very simply employed in machine shops and garages. It combines all the aspects of a conventional heavy duty lifting jack with the capabilities of simultaneously suspending an engine and a transmission plus operation of a ram press.

As with conventional booms, the invention is capable of removing engines from cars by means of a hoist and chain or if the engine is accessible, by attaching the engine plate to a portion of the engine. The telescopically extendable characteristics of the boom arm and base legs allow the unit to be easily positioned for any hard to reach areas.

The parallel support rods 56 are independently adjustable with respect to the boom 16 and either the boom or the rods may be lengthened or shortened to tilt the support bracket. By such tilting the transmission cradle or engine stand or both may be tilted to any desired degree.

The use of the adapter arm 48 may be employed to distance the engine stand plate from the end of the boom and the transmission cradle. In this manner the two may be used simultaneously or alternately. It will also be understood that the engine stand plate may be used in the sleeve 44 as desired.

The frame support 14 for the ram press, at right angles to the base 18, provides stability and counterweight for loads placed at the end of the boom. It further provides a stable and easily accessible support for the ram press 59. The ram press may be operated completely independently of the jack operation and the transmission cradle and engine stand. This avoids tie up of the available use of these features and makes possible full employment of the operative features of this invention.

Various changes and modifications may be made within this invention as will be apparent to those skilled in the art. Such changes and modifications are within the scope and teaching of this invention as defined in the claims appended hereto.

What is claimed is:

1. A lifting jack for automotive transmissions, engines and the like and a ram press, said lifting jack comprising a horizontally extending base, a support frame extending vertically from an end of said base, a horizontally extending boom pivotally connected to a top portion of said support frame, said boom having a free end extending over said base and having means for supporting simultaneously a transmission cradle and an engine stand, jack means supported on said base bearable upon said boom for raising and lowering said boom, said ram press being supported upon said support frame and being operable independently of said boom and said jack means.

2. A lifting jack for automotive transmissions, engines and the like and a ram press, said lifting jack comprising a horizontally extending base, a support frame extending vertically from an end of said base, a horizontally extending boom pivotally connected to a top portion of said support frame, said boom having a free end extending over said base and having means for supporting at least one of a transmission cradle and an engine stand, jack means supported on said base bearable upon said boom for raising and lowering said boom, said ram press being supported upon said support frame and being operable independently of said boom and said jack means, said support frame comprising a pair of vertically extending legs positioned on opposite sides of said base for stability and said ram press being supported between said legs.

3. The lifting jack of claim 2 in which a pair of upper and lower cross beams are supported on said legs, said ram press being supported upon the upper cross beam and said lower beam being vertically adjustable upon said legs.

4. The lifting jack of claim 2 in which said base is comprised of a pair of legs having free ends extending in divergent relation under the free end of said boom, said legs having opposite ends connected to a horizontally extending cross brace connected to a bottom portion of said support frame, said cross brace extending crosswise substantially beyond said legs and means for supporting the lifting jack under said support frame underneath ends of said cross brace.

5. A lifting jack for automotive transmission, engines and the like and a ram press, said lifting jack comprising a horizontally extending base, a support frame extending vertically from an end of said base, a horizontally extending boom pivotally connected to a top portion of said support frame, said boom having a free end extending over said base and having means for supporting at least one of a transmission cradle and an engine stand, jack means supported on said base bearable upon said boom for raising and lowering said boom, said ram press being supported upon said support frame and being operable independently of said boom and said jack means, and bracket means being provided at the free end of said boom, said bracket means having means for supporting said cradle stand and said engine stand.

6. The lifting jack of claim 5 in which said bracket means is pivotally connected in a vertical plane such that both the cradle stand and engine stand are pivoted therewith in a vertical plane.

7. The lifting jack of claim 6 in which said boom is pivotally connected to the top portion of said support frame and to said bracket means and a pair of parallel boom support rods extend parallel to said boom and are pivotally connected at opposite ends to said top portion of said support frame and to said bracket means, said boom and said support rods being independently telescopically adjustable in an axial direction to pivot said bracket means.

8. The lifting jack of claim 5 in which an engine stand adapter arm is adapted to be connected to said bracket means to connect said engine stand at a remote position underneath the free end of the boom, said adapter arm being elongated and having one end receivable in said bracket means and an opposite end receiving an engine stand plate portion of an engine stand.

9. The lifting jack of claim 7 in which said base is comprised of a pair of legs having free ends extending in diverging relation under the free end of said boom, the legs of the base being telescopically adjustable to extend the length of said base, all said legs of the base, said boom and said boom support rods being constructed of tubular metal having a rectangular cross-section to minimize twist and skew under load bearing conditions.

10. The lifting jack of claim 4 in which a cross support is connected between the legs of said base and provides a support for said jack means and said legs.

* * * * *